United States Patent [19]

Hyde

[11] 4,238,282

[45] Dec. 9, 1980

[54] CHEMICAL TREATMENTS IN BLEACHING STAGES WHICH INCREASE PULP BRIGHTNESS

[75] Inventor: James A. Hyde, Downers Grove, Ill.

[73] Assignee: Nalco Chemical Company, Oak Brook, Ill.

[21] Appl. No.: 59,821

[22] Filed: Jul. 23, 1979

[51] Int. Cl.[3] ..... D21C 9/12

[52] U.S. Cl. ..... 162/76; 162/79; 162/80; 162/89

[58] Field of Search ..... 162/76, 79, 80, 89, 162/87; 8/108 R, 108 A

[56] References Cited

U.S. PATENT DOCUMENTS

| | | | |
|---|---|---|---|
| 2,988,514 | 6/1961 | Robson et al. | 8/108 R |
| 3,539,445 | 11/1970 | Crossland | 162/76 |
| 3,652,385 | 3/1972 | Noreus et al. | 162/80 |

*Primary Examiner*—William F. Smith

*Attorney, Agent, or Firm*—John G. Premo; Robert A. Miller

[57] ABSTRACT

A method for increasing the final brightness of pulp contaminated with iron or manganese in a chlorine bleaching process of the type comprising one or more alkaline stages which comprises treating the pulp with at least 0.1 lbs. per ton of a water-soluble chelating agent.

4 Claims, No Drawings

CHEMICAL TREATMENTS IN BLEACHING STAGES WHICH INCREASE PULP BRIGHTNESS

INTRODUCTION

The bleaching of pulp by chemical means is a well-known phenomena and is described in the text, *Pulp and Paper Science and Technology,* Volume I, Pulp, Edited by C. Earl Libby, McGraw-Hill Book Company, 1962, Chapter 13 entitled, "Bleaching." The type bleaching with which the invention is concerned may be considered as the chlorine bleaching which, under mill conditions, is a multi-stage process. These stages typically consist of a chlorination stage (C), alkaline extraction (E), hypo chlorite treatment (H), which is an alkaline process, and chlorine dioxide stage (D). Many other processes using stages are known which involve basically themes or variations of the stages mentioned above. Several typical multi-stage bleaching processes are described in Casey cited above. For a more detailed description of multi-stage chlorine bleaching processes, reference may be had to "Chemical Environment of Pulp in the Bleaching Process," by N. Liebergott, *Pulp and Paper Magazine of Canada,* Pulp and Paper Research Institute of Canada Technical Paper T10, pp. 80–84, and "Principles of Pulp Bleaching," Parts I and II, by Vernon B. Bodenheimer and J. O. Enloe, *Southern Pulp and Paper Manufacturer,* Vol. 39, Nos. 3 and 4, published by Patchen, Mingledorff & Associates, Inc., Atlanta, Ga., March, 1976, issue, pp. 29–39, and April, 1976, issue, pp. 30–39.

For some time it has been known that the compounds of iron and manganese which can be contaminants in the pulp bleaching system tend to reduce the amount of brightness of the finished pulp. These contaminants come into the paper and pulp system in a variety of ways. It is generally the practice of pulp bleaching operations to increase the concentration of the chemicals used in the bleaching process to increase brightness or maintain it in the finished pulp. It would be though that a method of preventing iron or manganese reduction of brightness in pulping operations would be by complexing these materials in the water prior to their entry into the bleaching process. This approach is entirely impractical since it is impossible to treat these waters economically. Also, in most multi-stage bleaching processes, substantial quantities of the water are recycled, thereby continuing to build up iron and manganese contamination in the system.

The present invention is predicated upon the discovery that small amounts of water-soluble chelating agents may be added to the pulp being bleached, most preferably after the last alkaline stage, under acidic conditions, to prevent iron and manganese from interfering with the final brightness of the pulp after bleaching is completed. By practicing the invention, it is possible to reduce the amount of normal bleaching chemicals used or by using the same amount, to increase the final brightness of the bleached pulp.

THE INVENTION

The invention is a method for increasing the final brightness of pulp contaminated with iron or manganese in a chlorine bleaching process of the type comprising one or more alkaline stages which comprises treating the pulp with at least 0.1 lbs. per ton of a water-soluble chelating agent.

The Chelating Agents

The water-soluble chelating agents that may be used in the practice of the invention may be selected from any number of well-known commercially available chelants so long as they are capable of complexing with iron or manganese under the environment in which the invention is practiced. In addition to using single chelating agents, it is contemplated that one or more chelants may be formulated into a unitary product, which blended products oftentimes give superior results.

To illustrate the various types of chelants that may be employed, although the invention is not limited thereto, consideration should be given to the use of:

The Phosphonates

The phosphonate chelants comprise a large group of well-known phosphorus-containing materials. A most useful class of phosphonates are the hydroxy alkylidene diphosphonic acids having the formula:

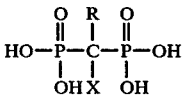

wherein X is OH or $NH_2$, and R is an alkyl of 1 to 5 carbon atoms, water soluble salts of said diphosphonic compound, and a mixture of said diphosphonic compound and said water-soluble salts thereof.

These compounds and their use as chelants are described more fully in U.S. Pat. No. 3,149,151.

The preferred phosphonate of this group is 1-hydroxyethylidene 1, 1-diphosphonic acid.

Another useful group of phosphonates are the phosphonates prepared by reacting ammonia, a primary or secondary amine, with phosphorus acid and an aldehyde such as formaldehyde. Phosphonates of this type are disclosed in U.S. Pat. No. 3,288,846, the disclosure of which is incorporated herein by reference. A preferred phosphonate of the type disclosed in this patent is tris amino trimethylene phosphonic acid and the phosphonates prepared by reacting a polyamine such as hexamethylene diamine with formaldehyde and phosphorus acid.

Although not phosphonates, I can use the so-called water-soluble substituted hypophosphites of the type disclosed in U.S. Pat. No. 4,088,678 and British Pat. No. 1,521,440, the disclosures of which are incorporated herein by reference. A preferred material of this type is sodium phosphinico BIS (succinic acid).

Still another group of useful phosphonates are those described in U.S. Pat. No. 3,886,204, which compounds are generically 2-phosphono-butane-1,2,3,4-tetracarboxylic acid. These compounds have the general formula:

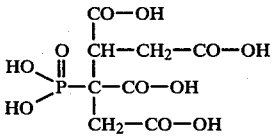

The preferred compound of this group useful in the practice of this invention is 1,2-phosphono-butane-1,2,4-tricarboxylic acid of the formula:

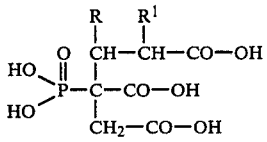

in which R is hydrogen or lower alkyl, and $R^1$ is hydrogen or methyl, and the alkali metal and ammonium salts thereof.

The Amino Carboxylates

This group of compounds is illustrated by the well-known chelating materials, ethylene diamine tetra acetic acid (EDTA) and nitrilo tris triacetic acid (NTA). Other related compounds which have chelating activity are described in U.S. Pat. No. 2,396,938 and U.S. Pat. No. 2,240,957, the disclosure of which is incorporated by reference.

In this group of chelants, NTA is particularly useful in complexing manganese, thus rendering it useful when manganese ions prevail in the system to be treated.

The Polymeric Chelants

These polymers encompass a large group of water soluble polymeric compounds. As indicated, these polymers should have a molecular weight of at least 1,000. When used herein the expression, "low molecular weight," encompasses polymers having a molecular weight range of from 1,000–40,000. Intermediate molecular weight polymers may be arbitrarily described as having molecular weights within the range of 40,000–500,000. High molecular weight polymers encompass all polymers having molecular weights greater than 500,000 and, in some instances, may be in excess of several million.

A class of water soluble polar addition polymers have, as a part of their molecular configuration, at least 5% by weight of side chain groups which will be either anionic or which, under conditions of alkaline hydrolysis, are capable of being converted into anionic functional groups.

These anionic polymers desirably contain as a functional side-chain group, carboxylic acid groups, carboxylic anhydride groups, carboxylic salt groups, carboxylic acid ester groups or carboxylic acid amide groups.

Surprisingly, very effective results have been obtained with the acrylic acid polymers or acrylic acid-methacrylic acid polymers which have molecular weights below 2000. These materials are particularly effective in complexing manganese in the systems treated in accordance with the invention.

Miscellaneous Chelating Agents

This group encompasses a large number of chelants that may be either organic or inorganic although they generally may be characterized as being acidic. Typical compounds are citric acid, tartaric acid, and gluconic acid. Other chelants are the well-known molecularly dehydrated phosphates such as sodium hexametaphosphate, sodium pyrophosphate, and sodium tripolyphosphate.

The Dosage

The amount of chelating agent used will vary depending upon the bleaching system being treated, the particular chelant selected, and the point of application for the chelant. Generally as little as 0.1 pounds per ton of pulp in the system represents a minimal dosage that is effective. Preferably between 0.5–5 pounds per ton will give good results although more may be used.

It is to be understood that the chelating agent may be added at any point in the system although, as previously indicated, it is preferably added after the last alkaline stage to an acidic point in the system. These acidic points in the system generally have a pH range from 2–6 whereas in most instances, the pH is about 5. It is at these pHs that the chelating agents are most effective.

EXAMPLES

To illustrate the invention, the following are given by way of example.

Listed below are a variety of chelating compositions that were evaluated in treating pulp during its bleaching in a variety of stages. The results of these tests are presented in Tables I–VIII.

Glossary of Chemical Treatments

| Composition No. | Description |
|---|---|
| 1 | Nitrilotris methylenephosphonic acid |
| 2 | 1-hydroxyethylidene 1,1-diphosphonic acid |
| 3 | Hexamethylenediaminetetrakis methylene-phosphonic acid |
| 4 | Diethylenetriaminepentakis methylene-phosphonic acid |
| 5 | 2 phosphonobutane - 1, 2, 4, tricarboxylic acid |
| 6 | Hexamethylenediamine tetramethylene phosphonic acid (mixed NA and K salt) |
| 7 | 80/20 acrylic acid methyl acrylate 5–10,000 MW by GPC analysis |
| 8 | EDTA |
| 9 | 50–100,000 MW by GPC analysis |
| 10 | Polyacrylic acid, 2000–2200 MW by GPC analysis |
| 11 | Polyacrylic acid, 2000 MW by GPC analysis |
| 12 | Hydrolized polymaleicanhydride, 800 MW by GPC analysis |
| 13 | Citric Acid |
| 14 | Hexameta phosphate |
| 15 | Pyro Phosphate |
| 16 | Sodium Tripolyphosphate |
| 17 | Gluconic Acid |
| 18 | Sodium phosphinico BIS (succinic acid) |
| 19 | Polyacrylate, 10,000 MW by GPC analysis |
| 20 | 70/30 AC AM copolymer, 20–30,000 MW by GPC Analysis |
| 21 | A blend of 10% Composition No. 2, 45% Composition No. 11, and 45% Composition No. 20 |
| 22 | Polyacrylate, 50,000 MW by GPC analysis |
| 23 | Polyacrylate, 120,000 MW by GPC analysis |
| 24 | 50/50 AC AM copolymer, 5,300 MW by GPC analysis |
| 25 | Tartaric Acid |
| 26 | Ascorbic Acid |
| 27 | NTA |

TABLE I

Treatment Dosage Level: A combination treatment of .5 lb/T to make up water of E and H bleaching stages and a level of 25 ppm added to wash waters of the E and H stages. Dosage calculated on a neat product basis.

Contamination: 3 ppm Fe added to all make-up and wash waters in both the E and H bleaching stages.

| Composition No. | D stage GE Air Dry Brightness | Brightness Loss | % Brightness Preservation |
|---|---|---|---|
| Control (No Contamination) | 88.0 | — | — |
| Fe Control (3 ppm Fe) | 83.1 | 4.9 | — |

TABLE I-continued

Treatment Dosage Level: A combination treatment of .5 lb/T to make up water of E and H bleaching stages and a level of 25 ppm added to wash waters of the E and H stages. Dosage calculated on a neat product basis.
Contamination: 3 ppm Fe added to all make-up and wash waters in both the E and H bleaching stages.

| Composition No. | D stage GE Air Dry Brightness | Brightness Loss | % Brightness Preservation |
|---|---|---|---|
| 2 | 86.4 | 1.6 | 67.3 |
| 16 | 85.4 | 2.6 | 46.0 |
| 15 | 85.4 | 2.6 | 46.0 |
| 9 | 85.1 | 2.9 | 40.8 |
| 7 | 84.6 | 3.4 | 30.6 |
| 13 | 84.4 | 3.6 | 26.5 |
| 14 | 84.4 | 3.6 | 26.5 |
| 5 | 84.3 | 3.7 | 24.5 |
| 1 | 84.0 | 4.0 | 18.4 |

TABLE II

Treatment Dosage Level: All treatments evaluated on an equal actives basis of 4 lb/T. The treatments were all applied to the make-up water of the D bleaching stage.
Contamination: The contamination was applied to the make-up and wash waters of the E and H stages at a level of 10 ppm Fe.

| Composition No. | D stage GE Air Dry Brightness | Brightness Loss | % Brightness Preservation |
|---|---|---|---|
| Control (No Contamination) | 81.4 | — | — |
| Fe control (10 ppm Fe) | 77.4 | 4.0 | — |
| 2 | 80.3 | 1.0 | 75.0 |
| 5 | 80.1 | 1.3 | 67.5 |
| 10 | 79.9 | 1.5 | 62.5 |
| 19 | 79.8 | 1.6 | 60.0 |
| 7 | 79.6 | 1.8 | 55.0 |
| 23 | 79.4 | 2.0 | 50.0 |
| 22 | 79.3 | 2.1 | 47.5 |
| 24 | 78.0 | 3.4 | 15.0 |

TABLE III

Objective: To compare the Fe analysis of pulp samples that are uncontaminated with samples that have been contaminated with Fe added to the make-up and wash water of the E and H bleaching stages. A second comparison was also made between the Fe contaminated control and samples treated with different levels of a formulated chemical treatment.
Treatment Dosage Level: All chemical treatments were applied to the make-up water of the D bleaching stage. The treatment was applied at levels from 2–8 lb/T.
Contamination: A contamination level of 10 ppm Fe was added to all make-up wash waters of the E and H bleaching stages.

| Composition No. | D stage GE Air Dry Brightness | Brightness Loss | % Brightness Preservation | Fe Analysis of Pulp Fib |
|---|---|---|---|---|
| Control (No Contamination) | 83.0 | — | — | 55 (ppm as Fe) |
| Fe control (10 ppm Fe) | 80.0 | 3.0 | — | 114 (ppm as Fe) |
| 21 | 80.6 | 2.4 | 20.0 | 118 (ppm as Fe) |
| 21 | 81.6 | 1.9 | 36.7 | 107 (ppm as Fe) |
| 21 | 81.9 | 1.1 | 63.3 | 83 (ppm as Fe) |
| 21 | 82.6 | 0.4 | 86.7 | 80 (ppm as Fe) |

TABLE IV

Treatment Dosage Level: All treatments were added to the D stage make-up water at a level of 8 lb/T neat product.
Contamination: Mn contamination was applied to the make-up and wash waters of the E and H stages at a level of 2 ppm Mn.

| Composition No. | D stage GE Air Dry Brightness | Brightness Loss | % Brightness Preservation |
|---|---|---|---|
| Control (No Contamination) | 83.0 | — | — |
| Mn control (2 ppm Mn) | 75.6 | 7.4 | — |
| 5 | 82.5 | .5 | 93.2 |
| 3 | 81.7 | 1.3 | 82.4 |
| 1 | 81.4 | 1.6 | 79.4 |
| 9 | 81.1 | 1.9 | 74.3 |
| 6 | 80.9 | 2.1 | 71.6 |
| 17 | 80.6 | 2.4 | 67.8 |
| 8 | 80.5 | 2.5 | 66.2 |
| 4 | 80.0 | 3.0 | 59.5 |
| 11 | 79.8 | 3.2 | 56.8 |
| 2 | 78.9 | 4.1 | 44.6 |
| 7 | 78.8 | 4.2 | 43.2 |
| 20 | 78.1 | 4.9 | 33.8 |
| 12 | 77.5 | 5.5 | 25.7 |

TABLE V

Treatment Dosage Level: All treatments were added to the D stage make-up water at a level of 4 lb/T neat product.
Contamination: Mn contamination was added to the make-up and wash waters of both the E and 4 bleaching stages at a level of 2 ppm Mn.

| Composition No. | D stage GE Air Dry Brightness | Brightness Loss | % Brightness Preservation |
|---|---|---|---|
| Control (No Contamination) | 83.0 | — | — |
| Mn control (2 ppm Mn) | 73.8 | 9.2 | — |
| 25 | 80.9 | 2.1 | 77.2 |
| 26 | 80.7 | 2.3 | 75.0 |
| 1 | 80.6 | 2.4 | 73.9 |
| 13 | 80.0 | 3.0 | 67.4 |
| 8 | 79.7 | 3.3 | 64.1 |
| 2 | 79.4 | 3.6 | 60.9 |
| 3 | 78.2 | 4.8 | 47.8 |
| 14 | 78.1 | 4.9 | 46.7 |
| 11 | 78.0 | 5.0 | 45.7 |
| 27 | 78.0 | 5.0 | 45.7 |
| 10 | 76.9 | 6.1 | 36.9 |
| 7 | 76.7 | 6.3 | 31.5 |
| 5 | 76.4 | 6.6 | 28.3 |
| 18 | 76.0 | 7.0 | 23.9 |
| 6 | 75.3 | 7.7 | 16.3 |

TABLE VI

Treatment Dosage Levels: All treatments were evaluated in the make-up water of the D stage at equal raw material cost level.
Contamination: Mn contamination was added to the make-up and wash waters of the E and H stages at a level of 5 ppm Mn.

| Composition No. | D Stage GE Air Dry Brightness | Brightness Loss | % Brightness Preservation |
|---|---|---|---|
| Control (No Contamination) | 85.3 | — | — |
| Mn Control (5 ppm Mn) | 75.5 | 9.8 | — |
| 27 | 82.0 | 3.3 | 66.3 |
| 11 | 81.3 | 4.0 | 59.2 |
| 20 | 80.7 | 4.6 | 53.1 |
| 7 | 80.3 | 5.0 | 49.0 |
| 14 | 79.8 | 5.5 | 43.9 |
| 17 | 79.2 | 6.1 | 37.8 |
| 2 | 79.2 | 6.1 | 37.2 |
| 25 | 79.1 | 6.2 | 36.7 |
| 1 | 78.5 | 6.8 | 30.6 |

TABLE VI-continued

Treatment Dosage Levels: All treatments were evaluated in the make-up water of the D stage at equal raw material cost level.
Contamination: Mn contamination was added to the make-up and wash waters of the E and H stages at a level of 5 ppm Mn.

| Composition No. | D Stage GE Air Dry Brightness | Brightness Loss | % Brightness Preservation |
|---|---|---|---|
| 13 | 78.4 | 6.9 | 29.6 |
| 6 | 77.9 | 7.4 | 22.5 |
| 18 | 77.7 | 7.6 | 22.4 |
| 3 | 77.5 | 7.8 | 20.4 |
| 8 | 76.6 | 8.6 | 12.2 |

TABLE VII

Objective: To determine if the ammonium salt of some chemical treatments show an improved activity against Fe related reversion.
Treatment Dosage: All treatments were applied at an equal raw material cost of 80 cents/T to the make-up water of the D stage. A treatment level at 4 lb/T Comp. 2 was included in this series as an example of a treatment with outstanding activity.

| Composition No. | D stage GE Air Dry Brightness | Brightness Loss | % Brightness Preservation |
|---|---|---|---|
| Control (uncontaminated) | 82.7 | — | — |
| Fe control (10 ppm Fe) | 79.0 | 3.7 | — |
| 2-4/T | 81.6 | 1.1 | 70.3 |
| 11-4/T | 80.2 | 2.5 | 33.4 |
| 2∝.7/T | 80.2 | 2.5 | 33.4 |
| 2-1.14.T ($NH_4$ salt) | 80.2 | 2.5 | 33.4 |
| 11-5.5/T ($NH_4$ salt) | 79.5 | 3.2 | 13.5 |

TABLE VIII

Objective: To determine if the ammonium salt of some chemical treatments show any improved activity against Mn related reversion.
Treatment Dosage: All treatments were applied at an equal raw material cost of 50 cents/T to the make-up water of the D stage.

| Composition No. | D stage GE Air Dry Brightness | Brightness Loss | % Brightness Preservation |
|---|---|---|---|
| Control (uncontaminated) | 83.9 | — | — |
| Mn Control (2 ppm Mn) | 81.0 | 2.9 | — |
| 11-2.8/T ($NH_4$ salt) | 82.6 | 1.3 | 55.2 |
| 50% Citric Acid-3/T | 82.5 | 1.4 | 51.7 |
| 11-2.5/T | 82.4 | 1.5 | 48.3 |
| 27-1.25/T | 81.9 | 2.0 | 31.0 |
| $NH_4$ Citrate 3/T | 81.7 | 2.2 | 24.1 |

I claim:

1. In a method of bleaching iron or manganese salt contaminated paper pulp in a chlorine bleaching process comprising one or more alkaline stages, the improvement which consists of addding to the iron or manganese salt contaminated paper pulp after the last alkaline stage when said pulp has an acid pH at least 0.1 lbs/ton of a water soluble chelating agent chosen from the group consisting of phosphonates, hydroxy alkylidene diphosphonates, and alkaline metal salt of a low molecular weight acrylic acid polymers, and mixtures thereof, such improvement increasing the final brightness of the paper pulp.

2. The method of claim 1 wherein the salt contaminant is predominantly iron salts and the chelating agent is a phosphonate.

3. The method of claim 2 where the phosphonate is a hydroxy alkylidene diphosphonate.

4. The method of claim 1 wherein the salt contaminant is predominantly a manganese salt and the chelating agent is an alkali metal salt of an acrylic acid polymer having a molecular weight less than 2000.

* * * * *